United States Patent [19]

Micheletti

[11] 4,248,065

[45] Feb. 3, 1981

[54] PROGRAMMING DEVICE FOR CIRCULAR STOCKING KNITTING MACHINES AND THE LIKE

[75] Inventor: Fabrizio Micheletti, Fucecchio, Italy

[73] Assignee: Brematex S.p.A, Prato, Italy

[21] Appl. No.: 941,204

[22] Filed: Sep. 11, 1978

Related U.S. Application Data

[63] Continuation of Ser. No. 829,247, Aug. 30, 1977, abandoned.

[51] Int. Cl.[3] ..... D04B 15/00

[52] U.S. Cl. ..... 66/237

[58] Field of Search ..... 66/154 R, 155, 138, 66/50 B

[56] References Cited

U.S. PATENT DOCUMENTS

| | | | |
|---|---|---|---|
| 1,140,709 | 5/1915 | Paxton et al. | 66/237 X |
| 1,525,610 | 2/1925 | Krieble | 66/138 |
| 2,516,697 | 7/1950 | Haddad | 66/50 B |
| 2,970,461 | 2/1961 | Hoffman | 66/237 X |
| 3,643,473 | 2/1972 | Strong | 66/237 X |
| 3,774,417 | 11/1973 | Bini | 66/237 X |
| 3,945,224 | 3/1976 | Billi | 66/237 X |

*Primary Examiner*—Wm. Carter Reynolds

*Attorney, Agent, or Firm*—Richards, Shefte & Pinckney

[57] ABSTRACT

Wide variations of the knitting program determined by the program drum of a circular knitting machine may be achieved by providing a plurality of rotatable program discs having peripheral seats for removable pins for determining supplementary programs and by providing followers co-operable with the program discs and linked to the means for advancing the program drum to selectively render the advancing means inoperative in dependence on the supplementary program. A driving linkage actuated by a cam track on the program drum is provided to allow relatively large angular advancement of the program drum when desired. Another driving linkage actuated by another cam track on the program drum is provided for reducing the speed of the needle cylinder.

2 Claims, 18 Drawing Figures

12
48
46
14
16
44A
7A
66
34
25
34B
26
22
f3
42
44
72
88
76A
66A
86
80
82
7
78
76
f6
70A
68A
28
30
24
62
64
32
84
9
10
102
114A

PROGRAMMING DEVICE FOR CIRCULAR STOCKING KNITTING MACHINES AND THE LIKE

CROSS REFERENCES TO RELATED APPLICATIONS

This is a continuation of co-pending application Ser. No. 829,247 filed Aug. 30, 1977, now abandoned.

FIELD OF THE INVENTION

The present invention relates to circular knitting machines, and more particularly to programming devices for circular knitting machines.

SUMMARY OF THE INVENTION

According to the invention, there is provided in a circular knitting machine, a needle cylinder, and a programming device for controlling the operation of the machine. The programming device includes a program drum and means for advancing the drum which comprises first drive ratchet-wheel means for rotating the drum, first drive pawl means for rotating the first drive ratchet-wheel means, and drive cam means rotatable with the needle cylinder to actuate the first drive pawl means. A plurality of rotatable program discs having peripheral seats for removable pins are provided for determining supplementary programs, having followers co-operable with the program discs and linked to the first drive pawl means to selectively render the first drive pawl means inoperative in dependence on the supplementary programs. A plurality of crown ratchet-wheel means are provided, each rotatable with a respective one of the program discs and each having a region without teeth and corresponding to a zero setting position of the associated program disc, whereby the program disc can stop in said zero setting position. A plurality of crown ratchet-wheel pawl means are also provided, each associated with a respective one of the crown ratchet-wheel means to rotate the crown ratchet-wheel means, drive means being rotatable with the needle cylinder for actuating the crown ratchet-wheel pawl means. Additionally, selector means is provided for causing each crown ratchet-wheel pawl means to drive its respective crown ratchet-wheel means.

BRIEF DESCRIPTION OF THE DRAWINGS

The invention will now be described, by way of example only, with reference to the accompanying diagrammatic drawings, in which.

DESCRIPTION OF THE PREFERRED EMBODIMENTS

Figure 1:
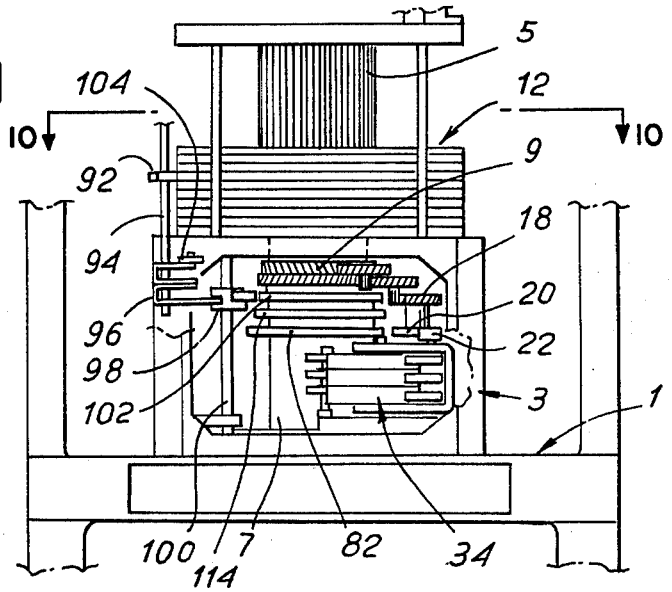
FIG. 1 is a schematic elevation of a knitting machine in accordance with the present invention.
Figure 2:
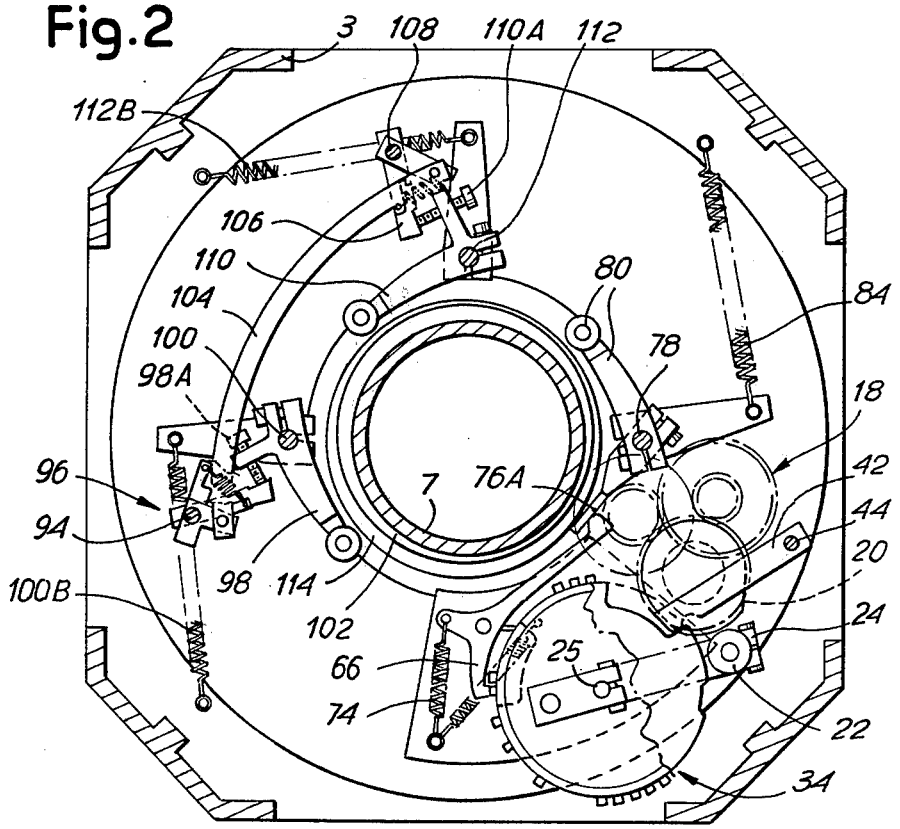
FIG. 2 is a plan view, in section and to an enlarged scale, of a knitting machine programming device embodying the present invention.
Figure 3:
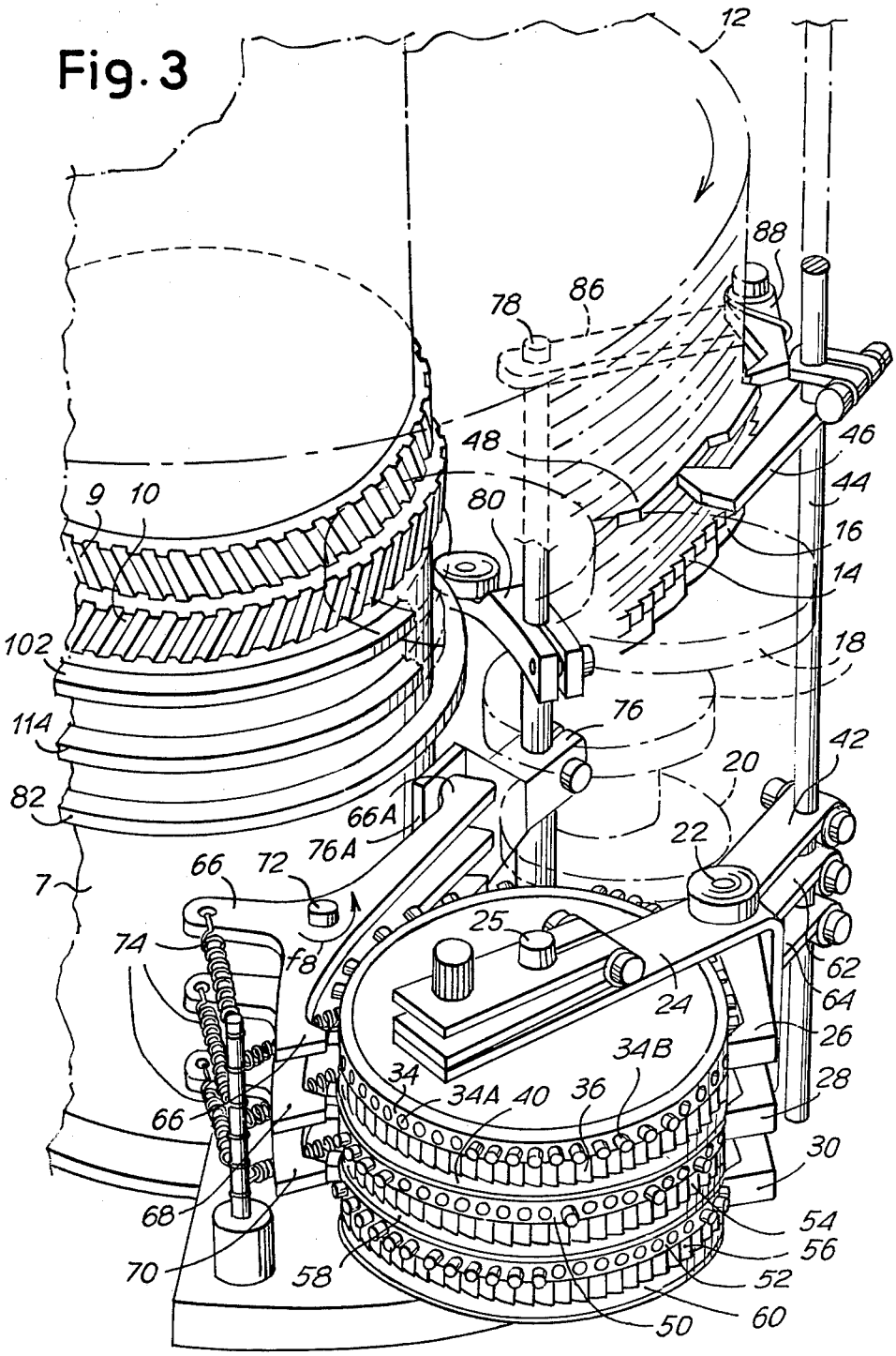
FIGS. 3 to 7 are fragmentary perspective views of the programming device of FIG. 2.
Figure 4:
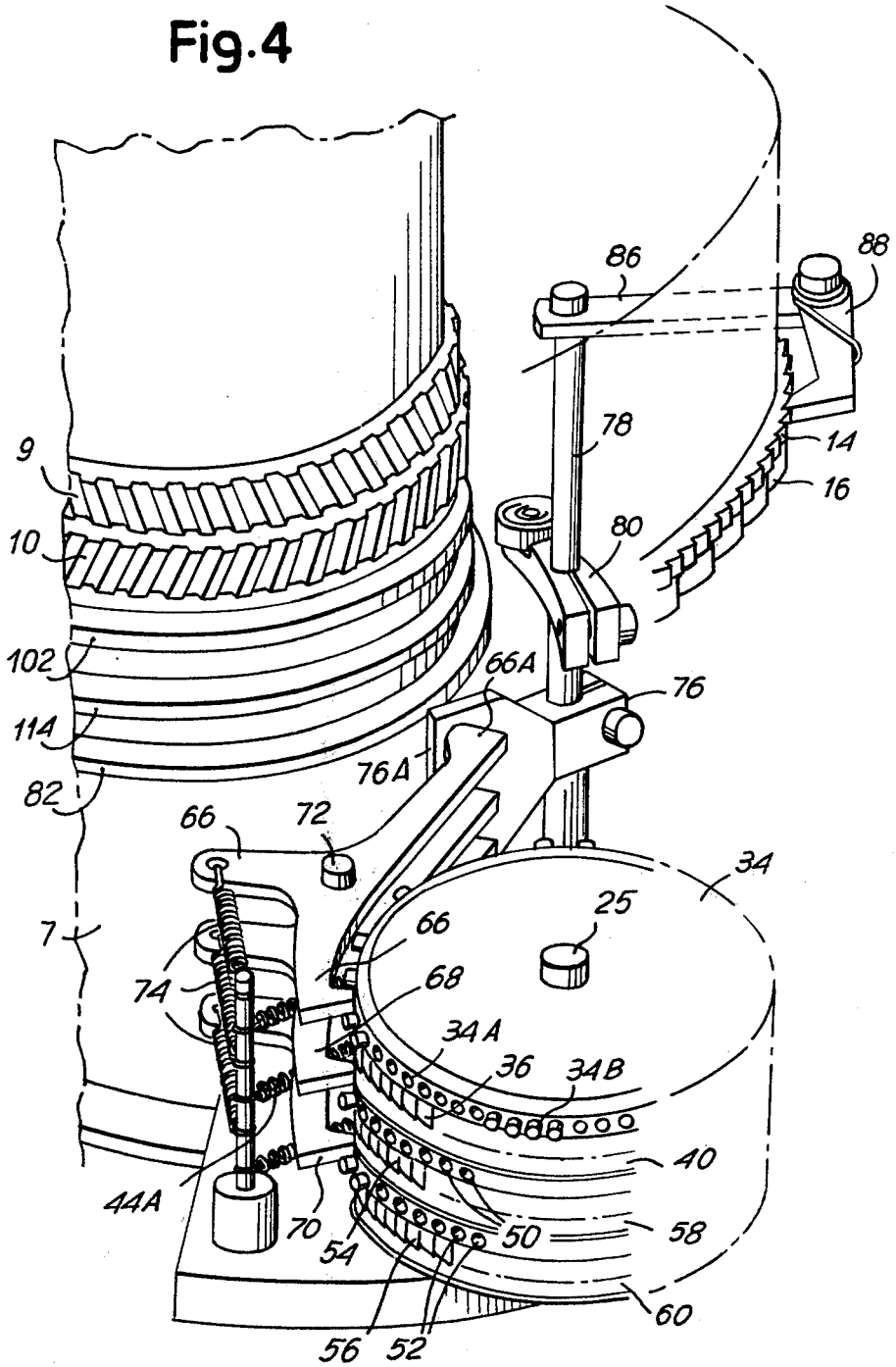
Figure 5:
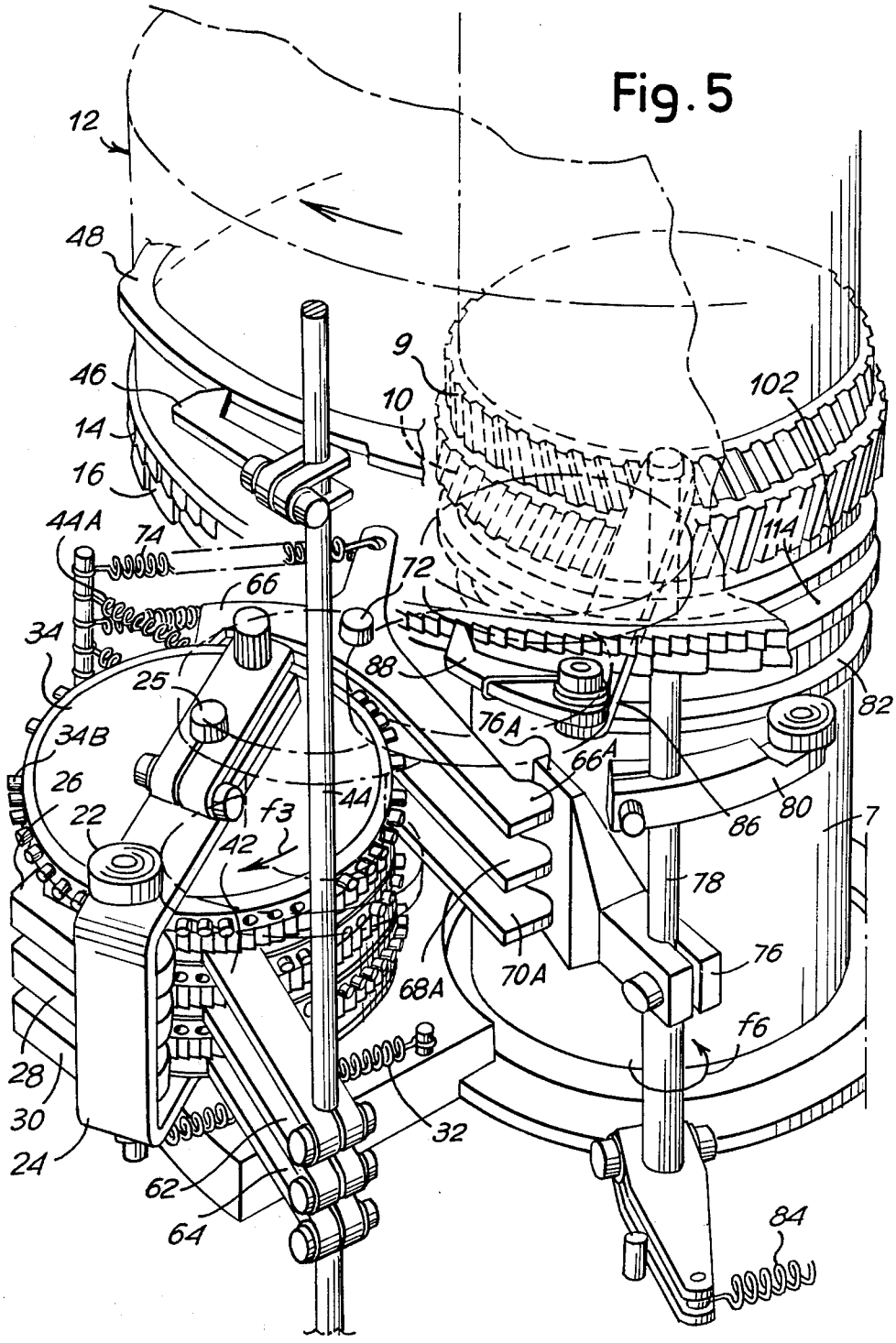
Figure 6:
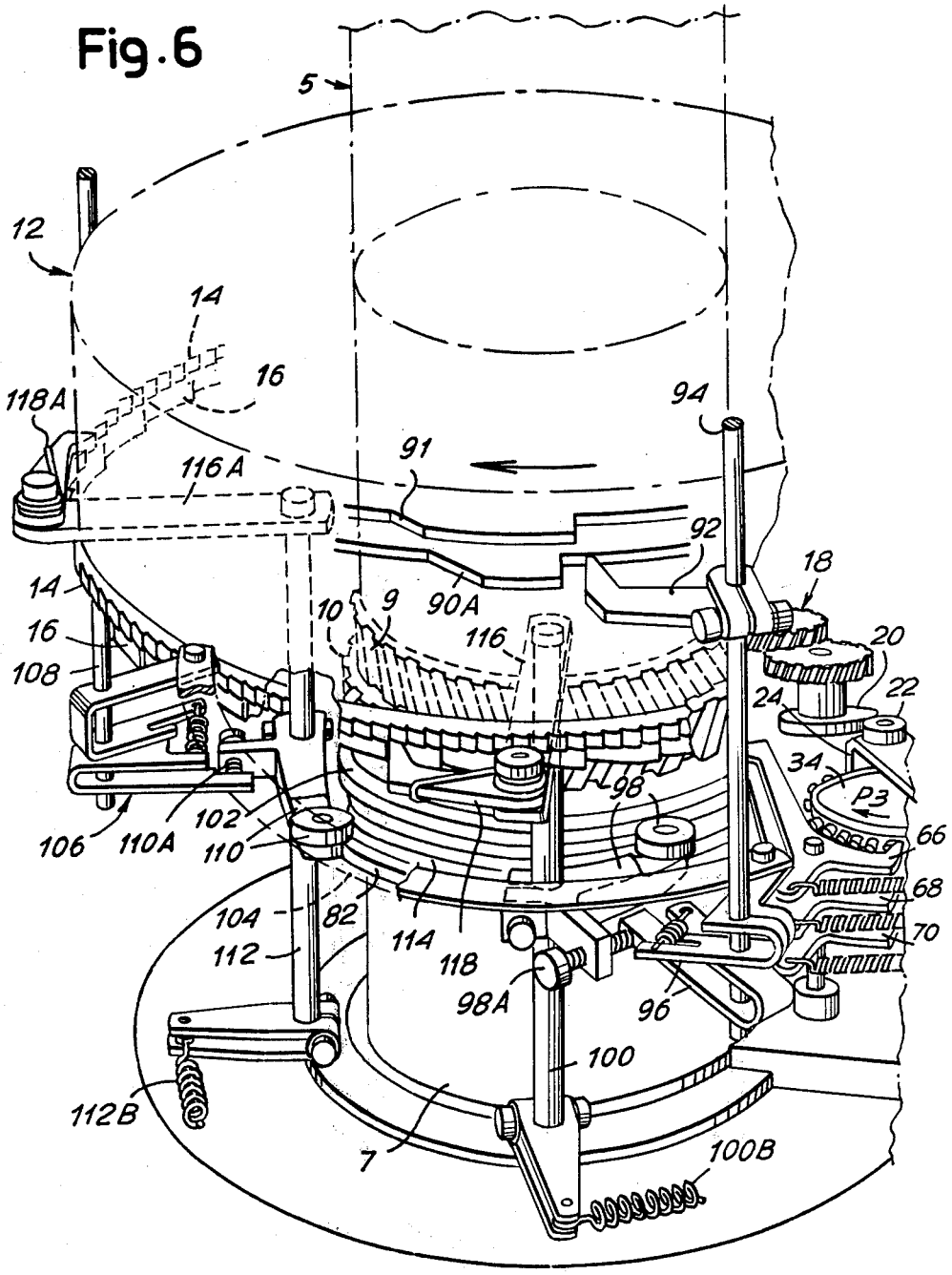
Figure 7:
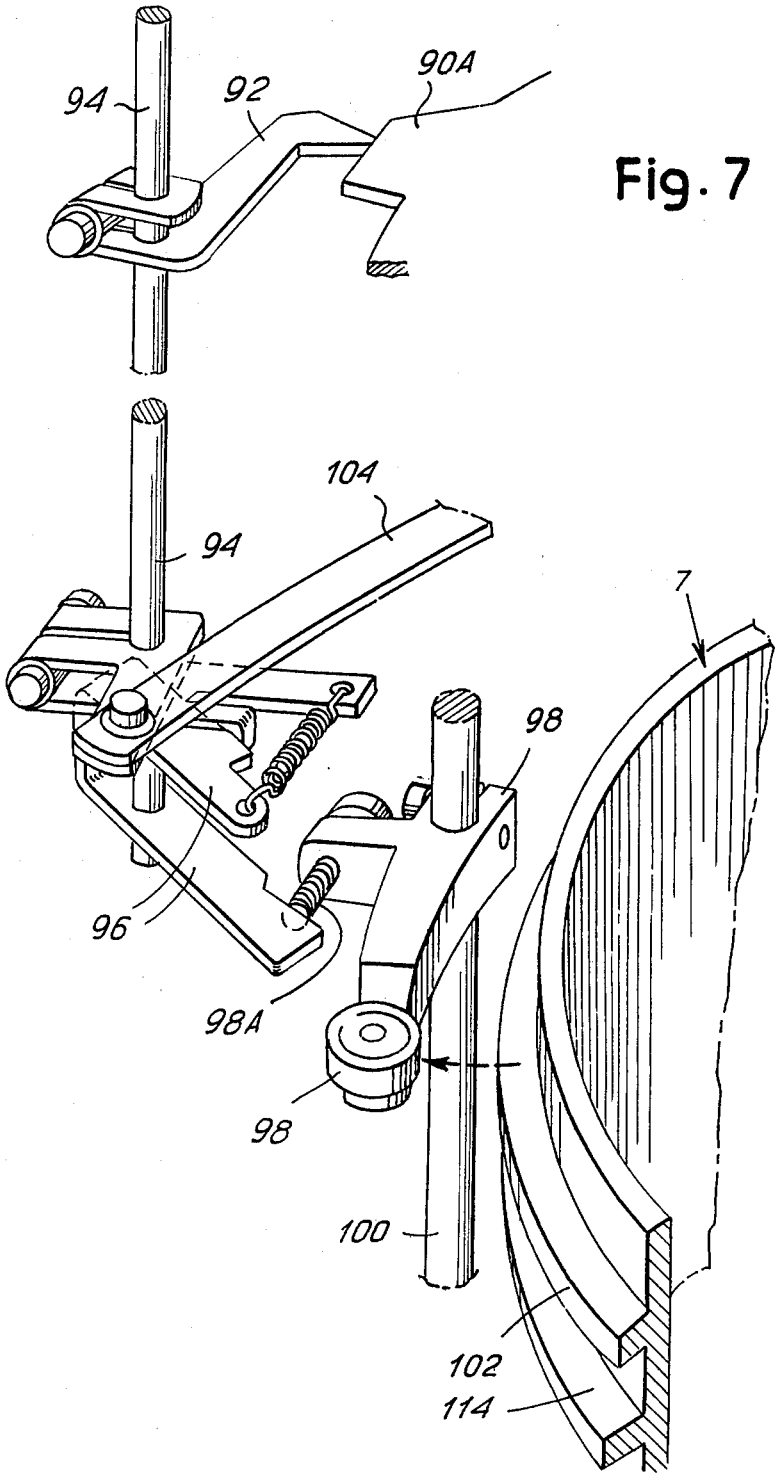

In the accompanying drawings, 1 indicates the base of a circular knitting machine having an upstanding frame 3 which carries a needle cylinder 5 which rotates continuously. The needle cylinder 5 has at its lower end a rotor 7 affixed for rotation with the cylinder 5 and carrying a set of cams for operating cam followers to be hereinafter described. The rotor 7 also includes a gear 9, which serves to transmit movement from the rotor to hereinafter described members. A second gear 10 on the rotor 7 is provided for manual operation. Coaxially with the needle cylinder 5 and with the rotor 7 there is mounted a rotatable program drum 12 having program cams for controlling components of the knitting machine and in particular for controlling the needles and jacks, and cams for controlling yarn guides for the replacement of the yarns. The drum 12 is continuously advanced in a stepwise manner by two saw-tooth drive ratchet-wheels, indicated respectively by 14 and 16, the former having closely-spaced teeth and the latter having more widely spaced teeth for the purposes hereinafter described.

Figure 8:
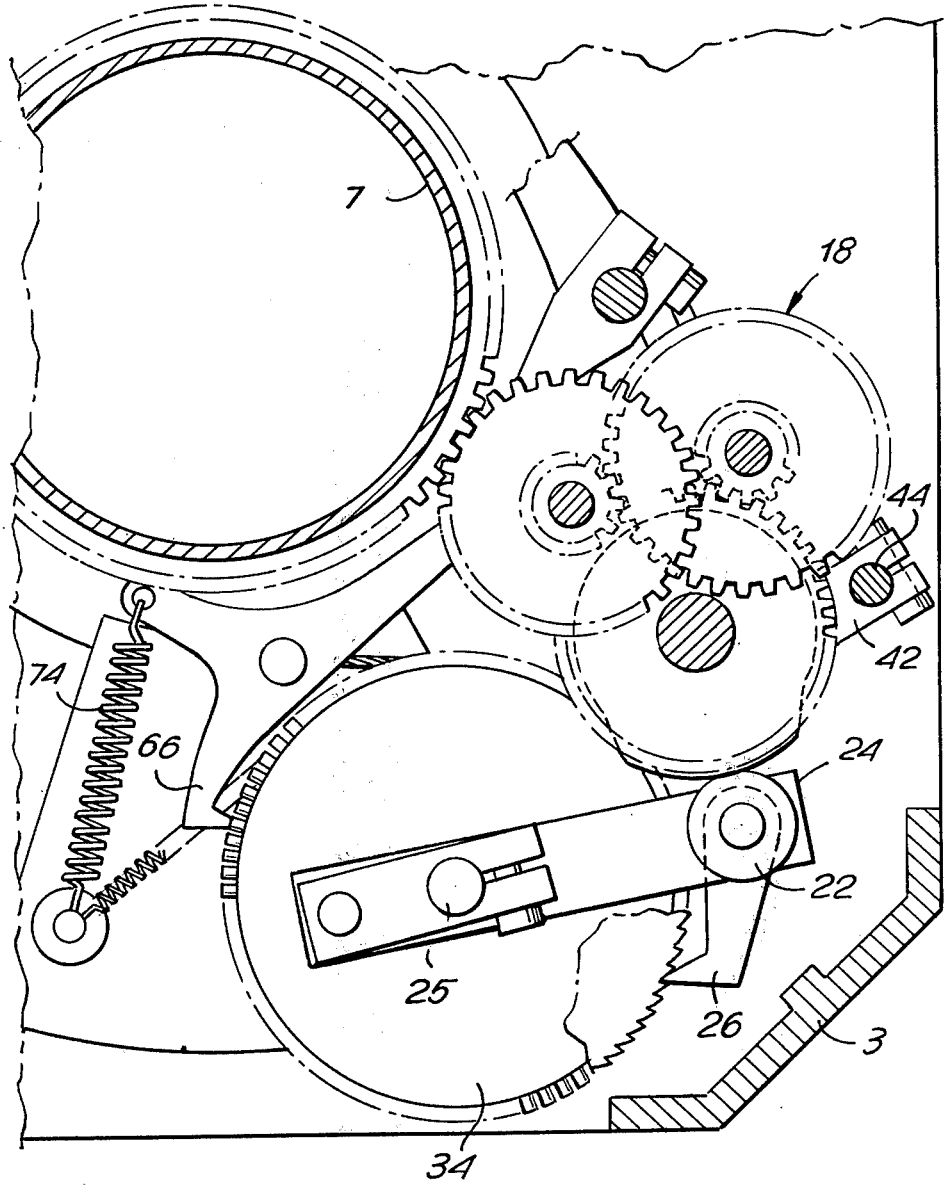
FIG. 8 is a fragmentary section of the programming device of the present invention taken along line 8—8 of FIG. 1.
Figure 9:
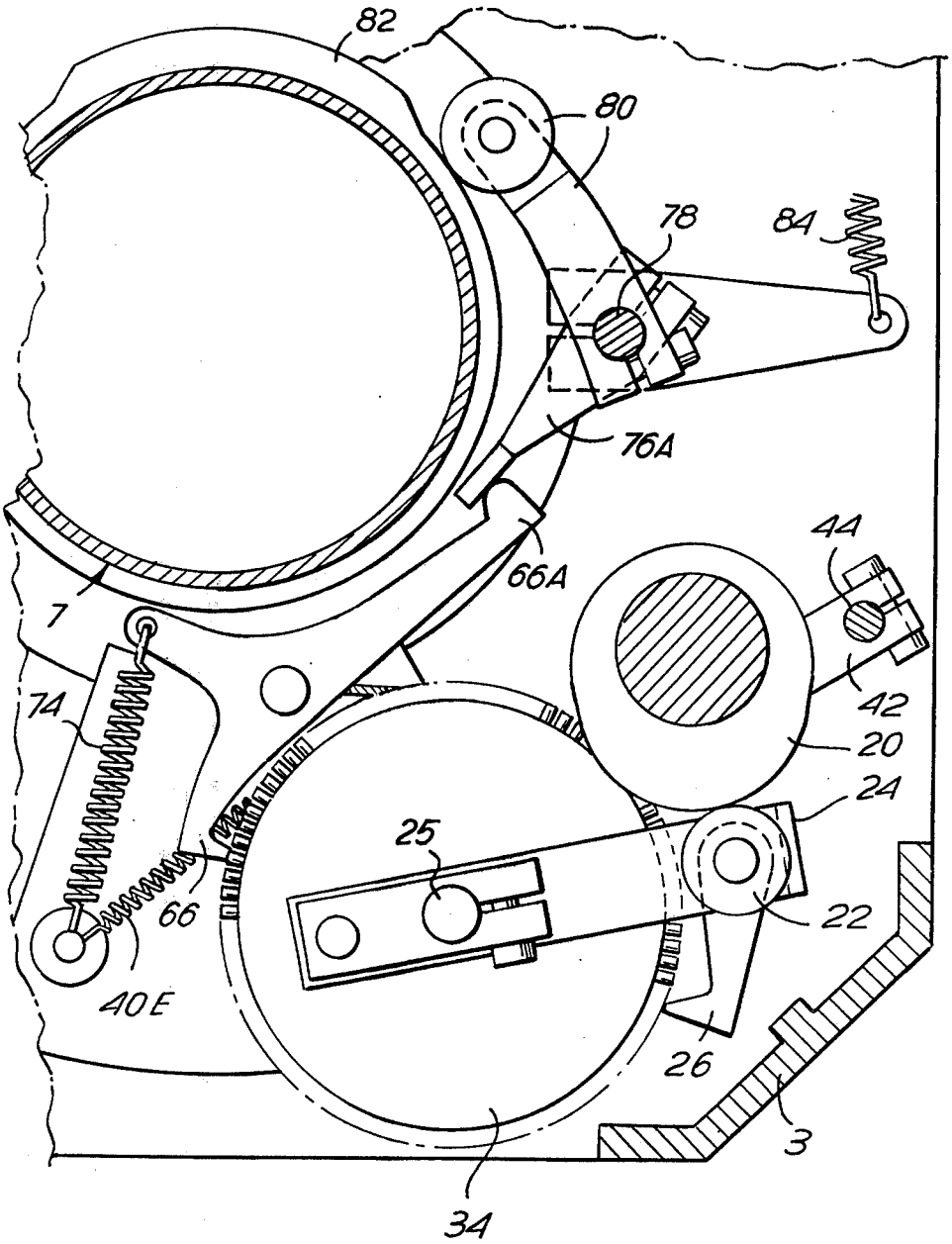
FIG. 9 is a fragmentary section of the programming device of the present invention taken along line 9—9 of FIG. 1.
Figure 10:
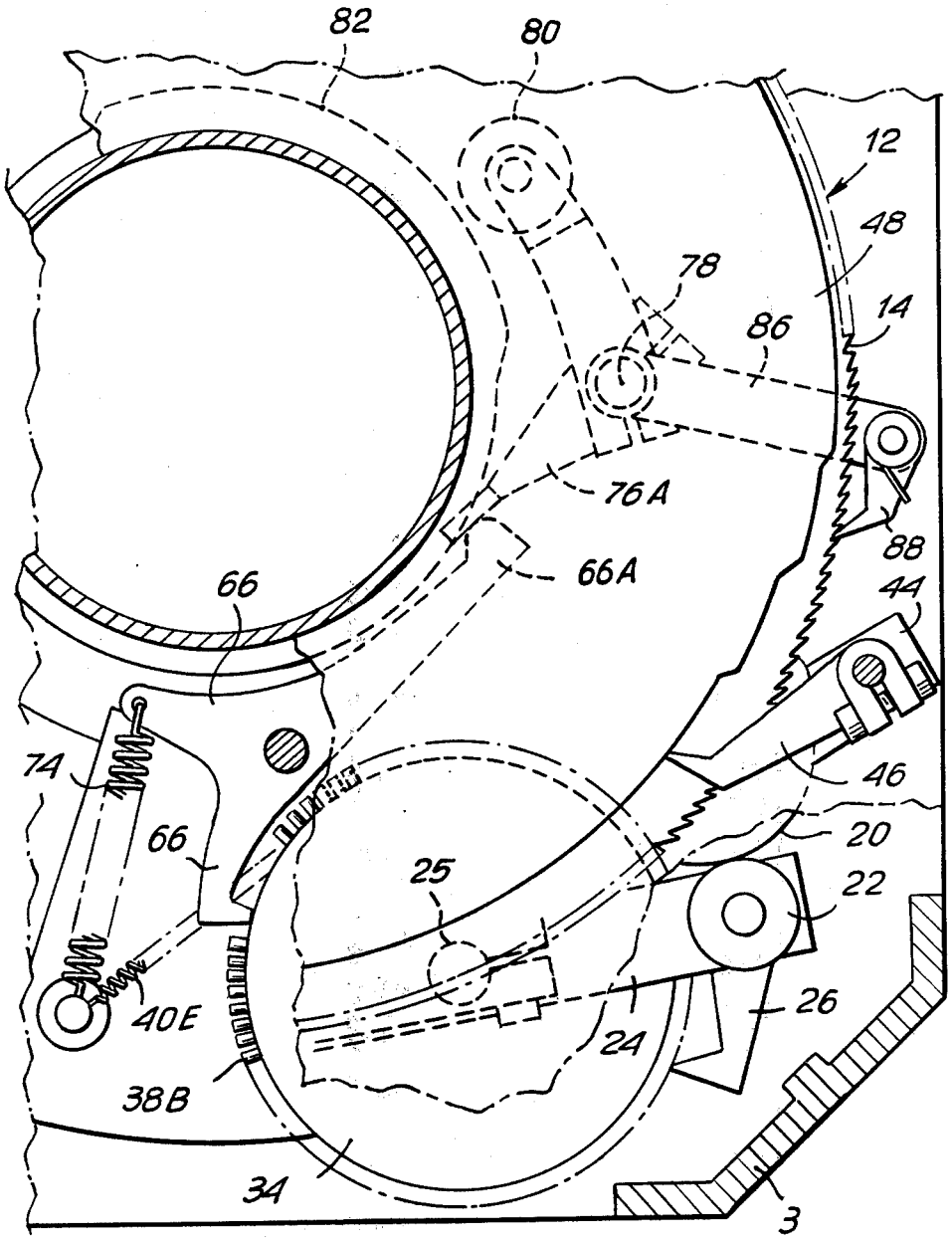
FIG. 10 is a fragmentary section of the programming device of the present invention taken along line 10—10 of FIG. 1.

The gear 9 transmits movement by means of a drive generally indicated at 18 in FIG. 8, which drives, with a large reduction, a cam 20 designed to effect reciprocating motion having a frequency much smaller than that of the needle cylinder 5. The cam 20 acts on a follower roller 22 borne by a stirrup-shaped element 24 mounted to oscillate on a shaft 25 which is vertical or otherwise parallel to the axis of the needle cylinder 5. On the axis of the follower 22, or otherwise linked to the stirrup element 24, there is provided a plurality of crown ratchet-wheel pawls for a corresponding number of program or pin discs, three pawls being employed in the preferred embodiment and indicated by 26, 28 and 30. The crown ratchet-wheel pawls 26, 28 and 30 are each urged by springs, not shown, against a corresponding crown ratchet-wheel to be described, the crown ratchet-wheel pawls 26, 28 and 30 being actuated in a forward direction by the cam 20 and being moved in the return direction by a spring 32 acting on the stirrup element 24.

Figure 12:
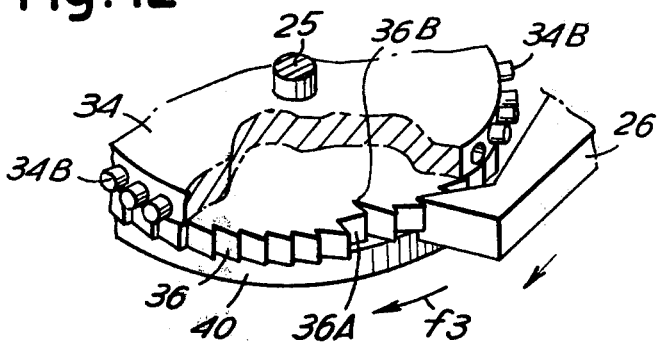
FIGS. 12, 13 and 14 are fragmentary perspective views illustrating the operation of program discs of the machine.
Figure 13:
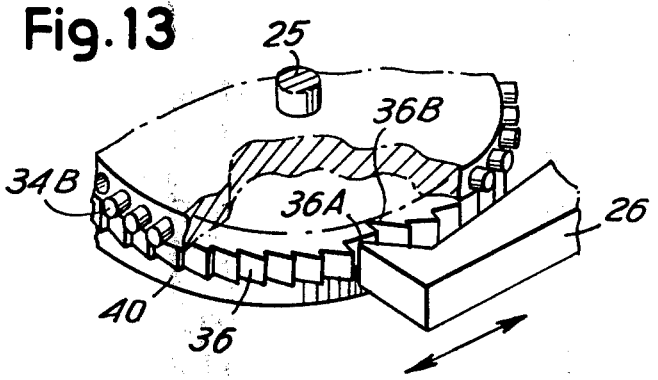
Figure 14:
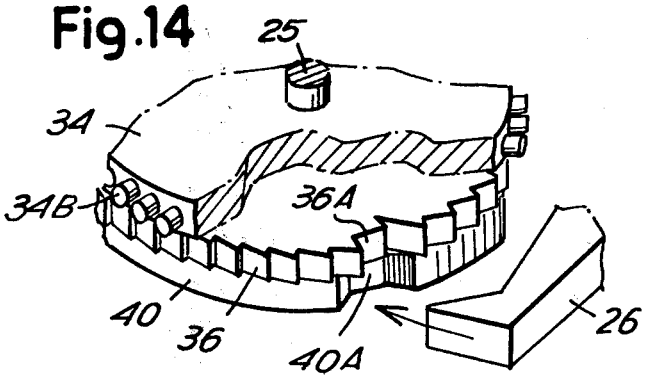
Figure 15:
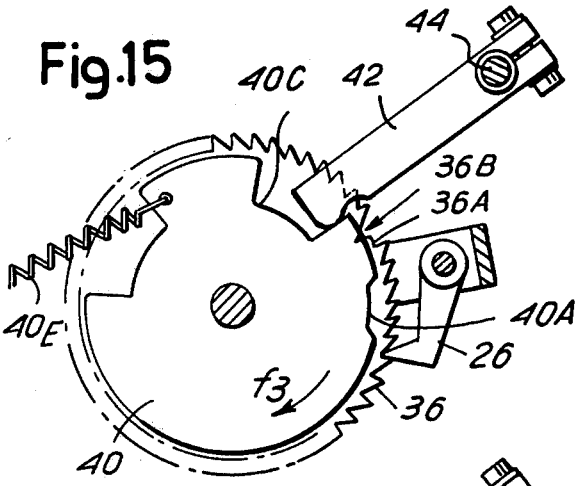
FIGS. 15, 16, 17 are plan views illustrating the operation of cam discs associated with the program discs.
Figure 16:
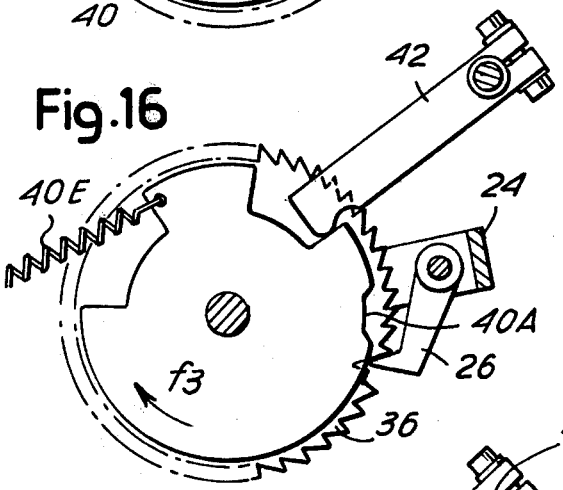
Figure 17:
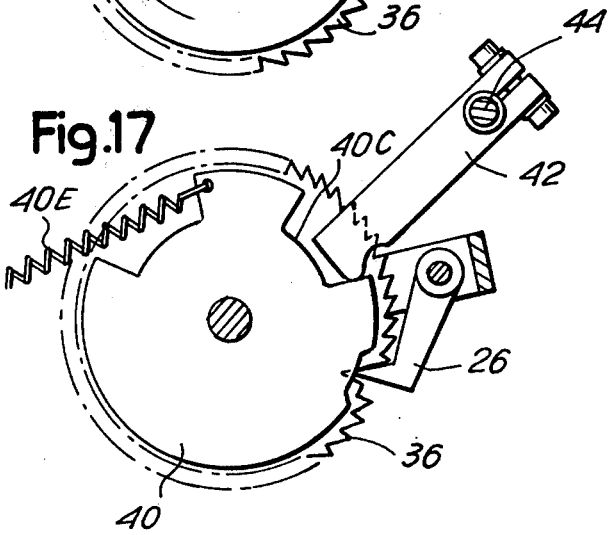

On the shaft 25, around which oscillates the stirrup element 24 carrying the crown ratchet-wheel pawls 26, 28 and 30, are assembled three program discs corresponding to the three pawls 26, 28 and 30. The first of the program or pin discs 34, which is associated with the pawl 26, is rigidly mounted with a crown ratchet-wheel 36 having saw-teeth on which acts the crown ratchet-wheel pawl 26, the two members 34 and 36 being idle with respect to the shaft 25 around which they rotate. The program disc 34 has, on its periphery, a plurality of radial seats 34A into and from each of which a pin 34B can be easily introduced and withdrawn. The presence or absence of the pins 34B provides a supplementary program to determine the action on members to be described in order to modify the advance of the program drum 12. Below the program disc 34 and rigidly coupled thereto there is provided the crown ratchet-wheel 36, on which the crown ratchet-wheel pawl 26 acts. The crown ratchet-wheel 36 has a set of uniform teeth, while, in a zero setting position of the supplementary program determined by the disc 34, it has a flattened region 36A (see FIGS. 12 to 14) where one of the teeth is missing. This flattened region is followed, in the direction of advance of the disc 34 and the crown ratchet-wheel 36 (as indicated by arrow f3), by a recess 36B. Oscillation of the crown ratchet-wheel pawl 26 when in correspondence with the flattened region 36A does not cause corresponding advance of the crown ratchet-wheel 36, the tooth of the pawl 26 merely sliding along the flattened region 36A and along the circumferential profile of an underlying cam disc 40. As a result, selector means are provided in order to enable the crown ratchet-wheel pawl 26 to again begin driving the crown ratchet-wheel 36 once the crown ratchet-wheel 36 has reached its zero position. The cam disc 40 is idle on the shaft 25 and is oscillable thereabout independently of the memers 34 and 36. The disc 40 has a recess 40A, which, when presented in the hereinafter described manner in correspondence of the flattened region 36A and the recess 36B, allows the crown ratchet-wheel pawl 26 to move into engagement with the recess 36B and impart an initial advance motion to the members 34 and 36 in the direction of the arrow f3, after an inactive period. Therefore the position of the cam disc 40 determines the start of the advance of the pin disc 34 starting from the recess 36B. The pin disc 34 thus started accomplishes one revolution until it returns to the zero setting position wherein the crown ratchet-wheel pawl 26 ceases to act owing to the presence of the flattened region 36A and the support which it receives from the cam disc 40, which in the meanwhile will have been moved in such a manner as to offset the recess 40A with respect to the zone of the crown ratchet-wheel pawl 26 as will now be described.

Figure 11:
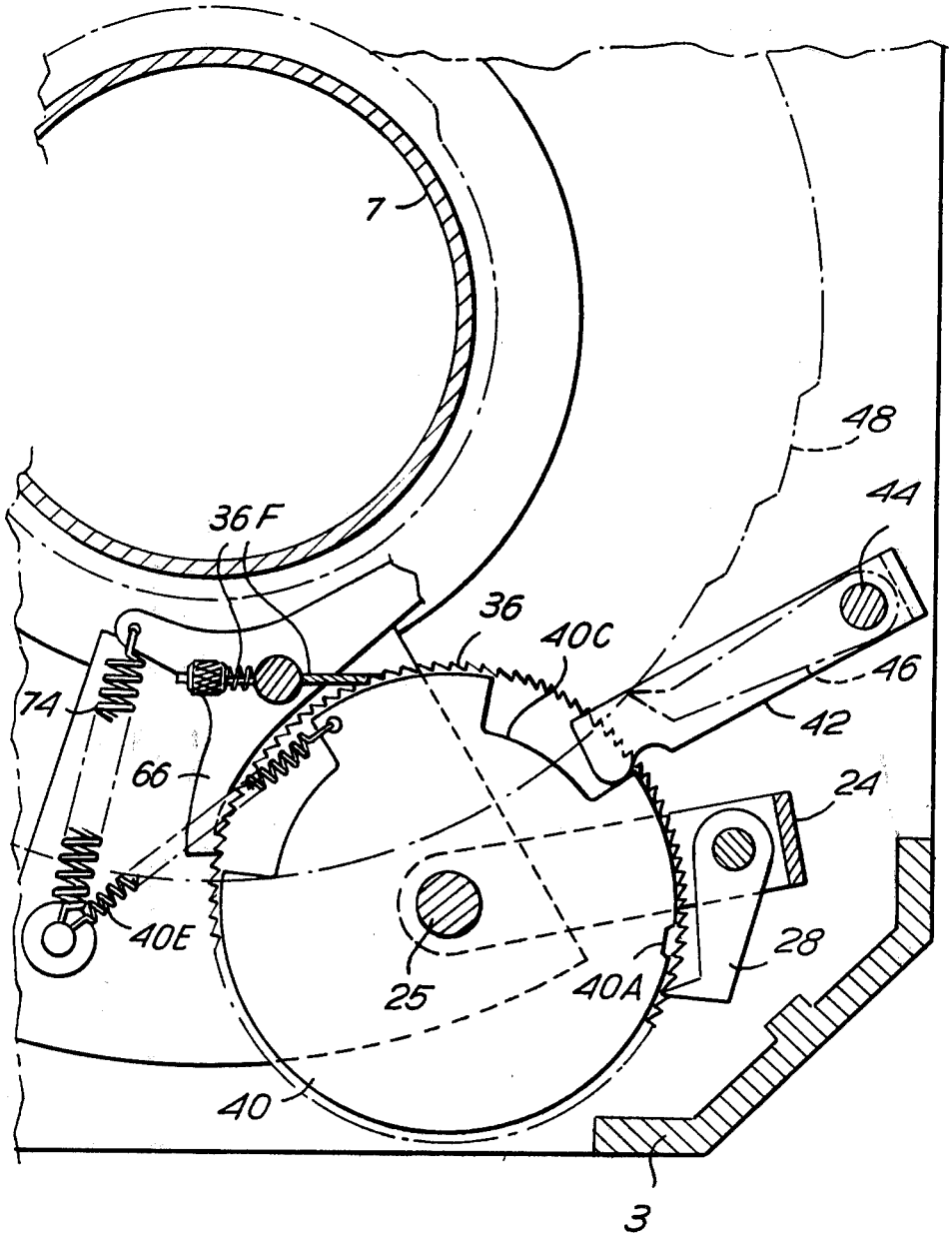
FIG. 11 is a fragmentary section of the programming device of the present invention taken along line 11—11 of FIG. 1.

The cam disc 40 is urged in a direction opposite to the arrow f3 by resilient means 40E (see FIGS. 11 and 12), but may be moved in the direction of the arrow f3 by the action of a lever 42 on a shoulder 40B of a recess 40C of the disc 40, the lever 42 being mounted on a shaft 44 parallel to the axis of the needle cylinder 5 and being provided with a follower 46 engageable with a stepped cam track 48 provided on the program drum 12. The cam track 48 is provided with steps having three levels to position the follower 46 and thereby the shaft 44 as well as the lever 42 and other equivalent levers in one of three different angular positions plus a neutral position.

In similar manner, a program or pin disc rigidly affixed to a crown ratchet-wheel is provided in correspondence with each of the remaining crown ratchet-wheel pawls 28 and 30 carried by the stirrup member 24, a pin disc 50 and a crown ratchet-wheel 54 being associated with the crown ratchet-wheel pawl 28 and a pin disc 52 and a crown ratchet-wheel 56 being associated with the crown ratchet-wheel pawl 30. Each crown ratchet-wheel 54 and 56 is provided with a flattened region and a deep recess similar to region 36A and recess 36B of crown ratchet-wheel 36. Additionally, each of the program/disc crown ratchet-wheel units 50–54 and 52–56 are associated with independently oscillable cam discs 58 and 60, respectively, similar to cam disc 40, each having a recess similar to the recess 40A and each having a recess similar to recess 40C having a shoulder similar to shoulder 40B of disc 40 for action thereupon by levers 62 and 64, respectively, which are rigid with the shaft 44. With this arrangement, according to the position reached by the program drum 12 and thereby by the cam track 48, the position of the cam discs 40, 58 and 60 is determined and thereby the selective stopping and starting of the corresponding pin discs 34, 50 and 52 and thus of the supplementary programs. The program disc units 34–36; 50–54; and 52–56 are appropriately braked by tie-rod means or the like, such as 36F.

Each of the pin discs 34, 50 and 52 is associated with a respective radial follower 66, 68 and 70, these followers being linked to a column 72 and being urged by springs 74 towards the periphery of the pin discs so as to engage the heads of the pins when pins are present, and to engage the periphery of the disc in absence of a pin. By their ends 66A, 68A, and 70A, each follower 66, 68, 70 is operative to act independently from the others on an end lug 76A of a lever 76, which is rigid with a small shaft 78 parallel to the axis of the needle cylinder 5. A follower 80 is rigid with the shaft 78 and is designed to co-act with a drive cam 82 of the rotor 7. The drive cam 82 serves, when the follower 80 is active, to oscillate the shaft 78 against the counteraction of a spring 84 and thereby oscillate a lever 86 rigid with the shaft 78 and bearing a first drive pawl 88 capable of acting on the first drive ratchet-wheel 14 which has closely spaced teeth of small pitch. The first drive ratchet-wheel 14 is rigid with the program drum 12 and is designed to determine small advances of the drum 12. When each of the followers 66, 68 and 70 engages a pin, such as that denoted by 34B of the disc 34, the ends 66A, 68A and 70A of the followers are moved away from the lug 76A. This movement determines, under the action of the spring 84, the rotation of the shaft 78 in the direction of the arrow f6 and causes thereby the follower 80 and the drive pawl 88 to oscillate so as to advance the program drum 12. The absence of a pin in correspondence of any one of the followers 66, 68, 70 causes movement of that follower in the direction of the arrow f8 to engage the lug 76A, which causes the follower 80 to be moved away from the drive cam 82, thereby interrupting the forward advance by the drive pawl 88 of the first drive ratchet-wheel 14.

When one of the pin discs 34, 50 and 52 is operating to carry out its own program, the other pin discs are located either in the zero setting position in which the respective crown ratchet-wheel pawls 26, 28 and 30 do not act thereon, or are moving to reach this zero setting position after accomplishin their own program, and during this movement there are present a continuous arc of pins such as those 34B, as well as in the zero setting position, whereby the respective follower does not prevent the operation of the follower 80 by the drive cam 82.

The means determining the control by the drive cam 82 on the follower 80 is thus only that one of the pin discs which is temporarily in operation. By means of the program formed by the absence or presence of pins, this pin disc determines, during its advance, the operation of the drive cam 82 on the feeler 80 and the interruption of this operation. For each pin in the program, there is an advance of the program drum 12 by the action of the first drive pawl 88 on the first drive ratchet-wheel 14 over one or a few pitches of the first drive ratchet-wheel 14 whereafter the drum 12 is stopped owing to the absence of the pins on the respective pin disc which is temporarily in operation, unless a device to be described intervenes, this device causing larger angular movements of the drum 12 than those attainable by the action of the drive pawl 88 on the first drive ratchet-wheel 14. It is to be noted that with the advance of the drum 12 there is also determined, by means of the cam track 48, the positioning of the cam discs, such as those denoted by 40, 58 and 60, and in this way there is optionally determined the advance and stopping of each of the pin discs. The pin discs 40, 58 and 60 may be operated in order to cover an entire revolution at each complete cycle of the machine, each independently from and after the other pin discs, or one may also provide for the interruption of the angular movement of a pin disc and the optional resumption of the movement by forming several flattened regions on the crown ratchet-wheels 36, 54 and 56 and corresponding recesses in the cam discs 40, 58 and 60.

When, following the control provided by the programs of the pin disc 34, 50 and 52, a relatively large angular movement of the program drum 12 is to be effected, there is employed a drive means acting upon the second drive ratchet-wheel 16 which means will now be described and which is activated by a second cam track 90 provided on the program drum 12 (side by side with a third cam track 91) and designed to act on a follower 92 mounted on a small shaft 94 parallel to the axis of the needle cylinder 5. The follower 92, by means of the shaft 94 and by means of an elastic coupling 96 formed by a pair of resiliently coupled levers, may act on a follower 98, which is mounted on a shaft 100 also parallel to the needle cylinder axis, a screw 98A being provided for adjusting the control position of the follower 98 with respect to th elements 92, 94, and 96.

The follower 98 is designed to contact a cam 102 of the rotor 7. The portion of the elastic coupling 96 which is rigid with the shaft 94 of the follower 92 is connected kinematically by means of an arcuate rod 104 with an additional elastic coupling 106 similar to the coupling 96 and mounted on a shaft 108. The elastic coupling 106 can act on a follower 110 similar to follower 98, by means of an adjustment screw 110A, the follower 110 being mounted for oscillation around a shaft 112. The shafts 100 and 112 are biased by springs 100B and 112B in such a direction as to resiliently urge the followers 98 and 110, respectively, against the cam 102 and a cam 114 also mounted on the rotary unit 7 rotating with the needle cylinder 5. Shafts 100 and 112 have rigidly affixed thereto respective mounting levers 116 and 116A which carry second drive pawls 118 and 118A, respectively, which act on the second drive ratchet-wheel 16 when the followers 98 and 110 are activated. Against the action of the springs 100B and 112B, the flexible couplings 96 and 106 act by the direct or indirect control of the follower 92 to move the followers 98 and 110 away from their respective cams 102 and 114, thereby preventing the action of the second drive pawls 118 and 118A on the second drive ratchet-wheel 16.

In a condition in which the drum 12 is stationary, the follower 92 is located in correspondence of a shoulder 90A of the second cam track 90 and thus the followers 98 and 110 are spaced from their respective cams 103 and 114. The shafts 100 and 112 being neutralized by the oscillation. It is to be noted that the cams 102 and 114 are so offset that, when the second drive pawls 118 and 118 A are active, they exert a substantially push-pull action on the second drive ratchet-wheel 16 to obtain an, on average, continuous motion of the program drum 12. If, following activation of the first drive pawl 88 by one of the pin discs 34, 50 and 52 the consequent small angular advance of the program drum 12, the projection 90A is moved beyond the follower 92, the follower 92 is moved inwardly. This movement of the follower 92 causes rotation of the shaft 94 and, by means of flexible couplings 96 and 106, activation of the followers 98 and 110, and thus the cylical oscillation, with a frequency determined by the speed of the needle cylinder 5, of the second drive pawls 118 and 118A, whereby to cause relatively swift advance of the program drum 12 with an, on average, continuous motion. This swift advance continues until the follower 92 encounters an additional projection 90A.

If, however, the projection 90A, which is present at the start of the small, slow angular, advance of the program drum 12 determined by one of the pin discs, remains present after the small advance obtained through the first drive pawl 88, then the program drum 12 only carries out this small advance. By suitably profiling the track 90, there can be selectively obtained a swift advance of the program drum 12 as a function of the programs imposed by means of the pin discs 34, 50 and 52.

Means are also provided for reducing the speed of the needle cylinder 5. The third cam track 91, which is located to one side of the second cam track 90 or is otherwise associated therewith, has similar projections to those of the track 90, but the projections of the track 91 start in advance of, and finish to the rear of, the projections of the track 90. This track 91 serves to operate suitable microswitches and/or relays (not shown) which reduce the speed of the machine during the stages of movement of the program drum 12, whereby to obtain movement at reduced speed. The speed is increased again immediately after the finish of the drum movement.

Figure 18:
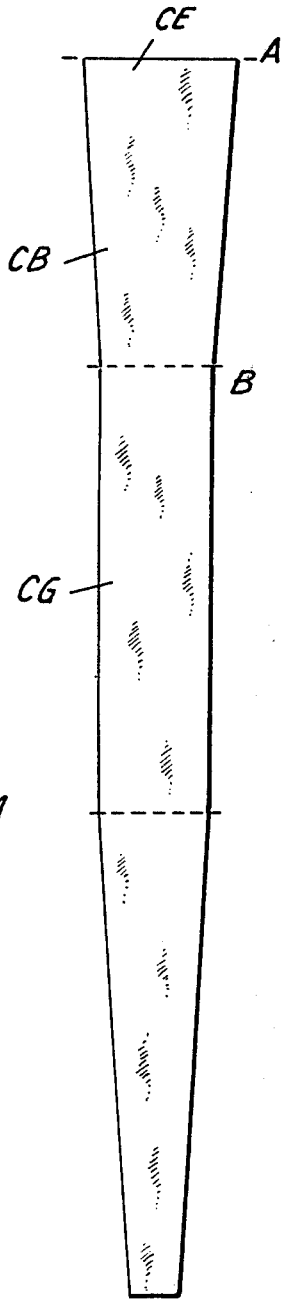
FIG. 18 shows an article which can be made by the knitting machine.

The arrangement described herein enables wide variations of the knitting program determined by the program drum, by means of supplementary programs determined by the pin discs and which can be easily modified by the insertion and removal of the pins. FIG. 18 shows a stocking knitted by means of the machine in which at level A the program is set to form an elastic portion CE an then an edge CB, ending at level B; with a supplementary program determined by the pin discs it is possible to vary the distance between levels A and B, regardless of the program to be carried out beyond level B. CG indicates the leg portion, which may also be varied departing from level B. The leg portion, also includes a narrowed length formed by the drive ratchet-wheel 14. Other supplementary programs may be used for the toe and/or the foot or other operations on the fabric.

Although the present invention has been described in relation to the preferred embodiments, it is to be understood that modifications and variations may be resorted to without departing from the substance or scope of the present invention as those skilled in the art will readily understand. Such modifications and variations are within the scope of the present invention, which is intended to be limited only by the appended claims and equivalents thereof.

What is claimed is:

1. A circular knitting machine comprising a rotatable needle cylinder, and a programming device for controlling the operation of the machine, said programming device including a program drum, means for advancing the drum comprising first drive ratchet-wheel means for rotating the drum, first drive pawl means for rotating the first drive ratchet-wheel means, and drive cam means rotatable with the needle cylinder to actuate the first drive pawl means, a plurality of rotatable program discs having peripheral seats for removable pins for determining supplementary programs, followers cooperable with the program discs and linked to the first drive pawl means to selectively render the first drive pawl means inoperative in dependence on the supplementary programs, a plurality of crown ratchet-wheel means each rotatable with a respective one of the program discs, each said crown ratchet-wheel means having a plurality of teeth and a region without teeth and corresponding to a zero setting position of the associated program disc, whereby the program disc can stop in said zero setting position, a plurality of crown ratchet-wheel pawl means each associated with a respective one of the crown ratchet-wheel means to rotate the crown ratchet-wheel means, drive means rotatable with the needle cylinder for actuating the crown ratchet-wheel pawl means, selector means for causing the crown ratchet-wheel pawl means to drive the crown ratchet-wheel means, the selector means comprising a plurality of cam discs, each associated with a respective one of the crown ratchet-wheel means and being idly mounted with respect thereto, a recess in each cam disc which, when aligned in correspondence with the said tooth free region of its respective crown ratchet-wheel means permits the respective crown ratchet-wheel pawl means associated therewith to start driving the crown ratchet-wheet means, a cam track on the program drum, and cam follower means associated with the cam track to cause the respective cam discs to rotate such that the recesses of the cam discs move into alignment with the tooth free regions of their respectively associated crown ratchet-wheel means.

2. A knitting machine according to claim 1, wherein the tooth-free region of each crown ratchet-wheel means has a recess in which the crown ratchet-wheel pawl means can engage to drive the crown ratchet-wheel means when the recess in the associated cam disc moves into alignment with the recess in the tooth-free region.

* * * * *

UNITED STATES PATENT OFFICE

CERTIFICATE OF CORRECTION

Patent No. 4,248,065 Dated February 3, 1981

Inventor(s) Fabrizio Micheletti

It is certified that error appears in the above-identified patent and that said Letters Patent are hereby corrected as shown below:

Column 3, line 23, delete "memers" and insert therefor --members--. Column 4, line 51, delete "accomplishin" and insert therefor --accomplishing--. Column 5, line 20, delete "disc" and insert therefor --discs--. Column 5, line 34, delete "th" and insert therefor --the--. Column 5, line 62, delete "103" and insert therefor --102--. Column 6, line 2, after "52" insert --and--. Column 6, line 8, delete "cylical" and insert therefor --cyclical--.

Signed and Sealed this

*Twenty-sixth* Day of *January 1982*

[SEAL]

*Attest:*

GERALD J. MOSSINGHOFF

*Attesting Officer*

*Commissioner of Patents and Trademarks*